US006752325B2

(12) United States Patent
Kropp et al.

(10) Patent No.: US 6,752,325 B2
(45) Date of Patent: Jun. 22, 2004

(54) FUEL INJECTION DEVICE

(75) Inventors: Martin Kropp, Tamm (DE); Hans-Christoph Magel, Pfullingen (DE); Wolfgang Otterbach, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/022,870

(22) Filed: Dec. 20, 2001

(65) Prior Publication Data

US 2002/0088435 A1 Jul. 11, 2002

(30) Foreign Application Priority Data

Dec. 20, 2000 (DE) ..... 100 63 545

(51) Int. Cl.[7] ..... F02M 47/02

(52) U.S. Cl. ..... 239/88; 239/90; 239/95; 239/96; 239/124; 239/533.4

(58) Field of Search ..... 239/88–93, 95, 239/96, 124, 533.4; 123/447

(56) References Cited

U.S. PATENT DOCUMENTS

| | | | | | |
|---|---|---|---|---|---|
| 4,459,959 | A | * | 7/1984 | Terada et al. | 123/447 |
| 5,732,679 | A | * | 3/1998 | Takahasi et al. | 123/447 |
| 5,771,865 | A | * | 6/1998 | Ishida | 123/447 |
| 6,453,875 | B1 | * | 9/2002 | Mahr et al. | 123/447 |
| 6,513,497 | B1 | * | 2/2003 | Mahr et al. | 123/447 |
| 6,536,416 | B1 | * | 3/2003 | Mahr et al. | 123/447 |

* cited by examiner

*Primary Examiner*—Dinh Q. Nguyen
(74) *Attorney, Agent, or Firm*—Ronald E. Greigg

(57) ABSTRACT

An injection nozzle of a stroke-controlled fuel injection device has a control chamber for triggering a nozzle needle and also has a nozzle chamber connectable to a pressure booster. The communication between a differential chamber of the pressure booster and a leakage line and the communication between a control chamber and a leakage line are controllable with the aid of a common valve.

6 Claims, 4 Drawing Sheets

FUEL INJECTION DEVICE

BACKGROUND OF THE INVENTION

1. Field of the Invention

The invention relates to a fuel injection device for use in an internal combustion engine.

2. Description of the Prior Art

For better comprehension of the description and claims, several terms will first be explained: The fuel injection device of the invention is embodied in stroke-controlled fashion. Within the scope of the invention, a stroke-controlled fuel injection device is understood to mean that the opening and closing of the injection opening is effected with the aid of a displaceable nozzle needle, on the basis of the hydraulic cooperation of the fuel pressures in a nozzle chamber and in a control chamber. A pressure drop inside the control chamber causes a stroke of the nozzle needle. The pressure at which fuel emerges from the nozzle chamber into a cylinder of an internal combustion engine is called the injection pressure, while the term system pressure is understood to mean the pressure at which fuel is available or kept on hand inside the fuel injection device. Fuel metering means furnishing a defined fuel quantity for injection. The term leakage is understood to mean a quantity of fuel that occurs in operation of the fuel injection device (such as a reference leakage or a control quantity) that is not used for injection and is pumped back to the fuel tank. The pressure level of this leakage can have a standing pressure, and the fuel is then subsequently depressurized to the pressure level of the fuel tank.

A stroke-controlled fuel injection device with a pressure booster has become known from German Patent Disclosure DE 199 10 970 A1. Each injection nozzle of a common rail system is assigned a hydraulic pressure booster, which enables both an increase in the maximum injection pressure to high pressures, such as pressures above 1800 bar, and the furnishing of a second injection pressure. By means of the pressure booster, the pressure storage chamber and the injection nozzle are subjected to a lower, permanent pressure level (rail pressure) than in conventional common rail systems and thus has a longer service life. The high-pressure pump is also subjected to less stress. The possibility exists of a well-meterable preinjection with low tolerances, by means of a low (unboosted) injection pressure. By switching over between injection pressures, a flexible shaping of the injection rate can be achieved, along with a plurality of preinjections and postinjections at high and low injection pressure, respectively.

OBJECT AND SUMMARY OF THE INVENTION

To reduce the effort and expense in a fuel injection system with a pressure reservoir and a pressure booster, only a single valve is used to trigger the pressure booster and the nozzle needle. The present invention reduces the effort and cost of producing the valves and the effort and cost for the associated control electronics in the control unit. The disadvantage of the reduced flexibility of the injection course can be compensated for by suitable delay members. Adapting delay members makes it possible to adapt the behavior over time of the pressure buildup by the pressure booster to the demand presented by the engine.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
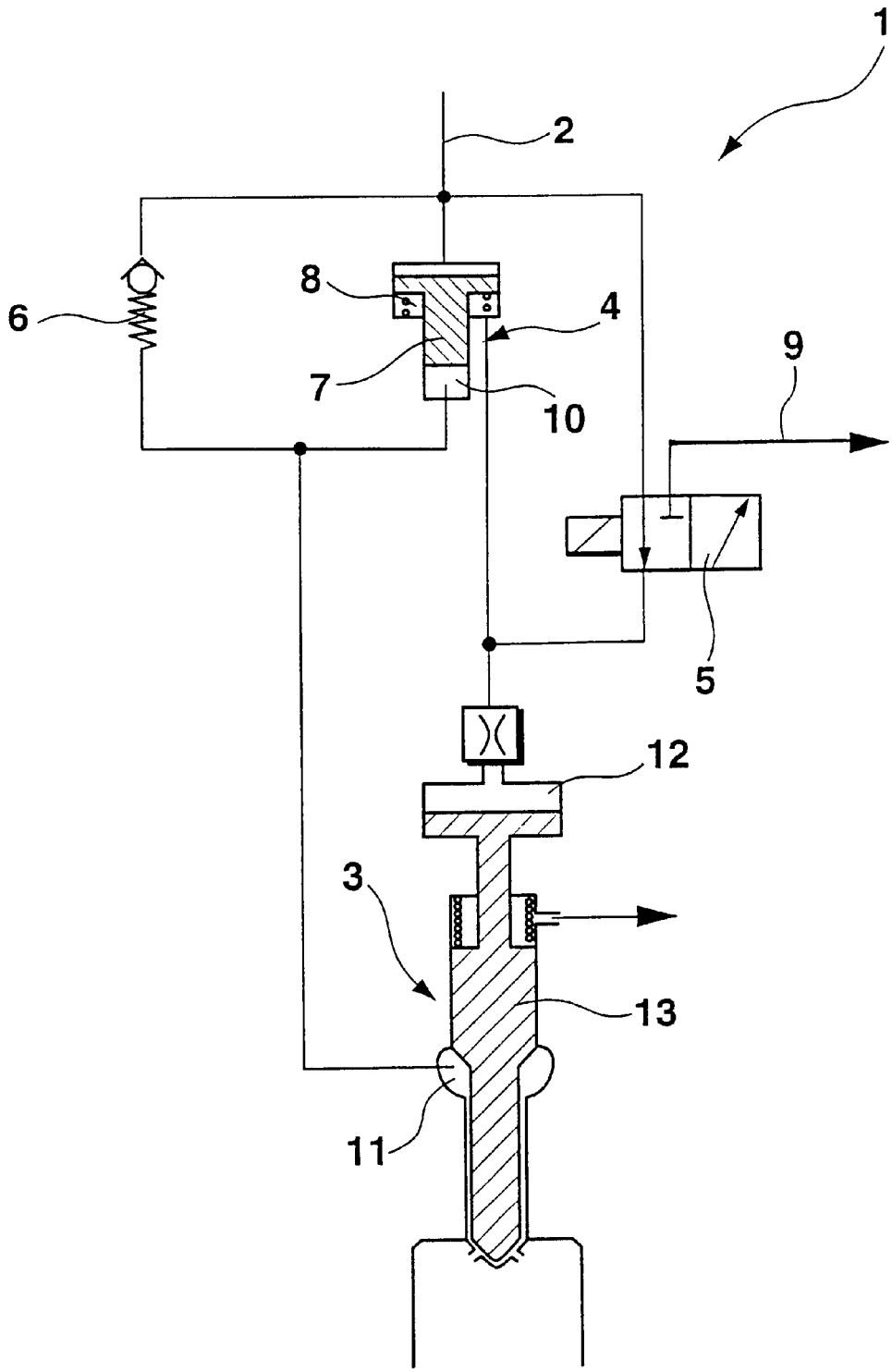
FIG. 1 shows a first stroke-controlled fuel injection device.

In the first exemplary embodiment, shown in FIG. 1, of a stroke-controlled fuel injection device 1, a fuel pump pumps fuel out of a tank via a feed line into a central pressure storage chamber (common rail), from which a plurality of pressure lines 2, corresponding in number to the number of individual cylinders, lead away to the individual injection nozzles 3 that protrude into the combustion chamber of the internal combustion engine to be supplied. In FIG. 1, only one of the injection nozzles 3 is shown. With the aid of the fuel pump, a first system pressure is generated and stored in the pressure storage chamber. This first system pressure is used for preinjection and as needed for postinjection (hydrocarbon enrichment for posttreatment of the exhaust gas or soot reduction) as well as for forming an injection course with a plateau (boot injection). For injecting fuel at a second, higher system pressure, each injection nozzle 3 is assigned a local pressure booster 4. The pressure booster 4 and the injection nozzle 3 are triggered via a common 3/2-way valve 5. The pressure booster 4 is also assigned a check valve 6. A piston 7 can be subjected to pressure by fuel on one end via the pressure line 2. A differential chamber 8 can be connected by means of the valve 5 to a leakage line 9 and thus pressure-relieved, so that the piston 7 can be displaced to reduce the volume in a pressure chamber 10. The piston 7 is moved in the compression direction, so that the fuel located in the pressure chamber 10 is compressed and delivered to a nozzle chamber 11. The check valve 6 prevents compressed fuel from flowing back into the pressure storage chamber.

A control chamber 12 of the injection nozzle 3 is also switched by means of the valve 5. If the valve 5 is triggered and the control chamber 12 is in communication with the leakage line 9, the pressure in the control chamber 12 and in the differential chamber 8 of the pressure booster 4 drops simultaneously. Thus by the opening of a nozzle needle 13, an injection is initiated. The pressure booster 4 is simultaneously triggered for a pressure buildup. If the valve 5 closes again, then the nozzle needle 13 is closed hydraulically. The pressure booster 4 returns to its outset position.

Figure 2:
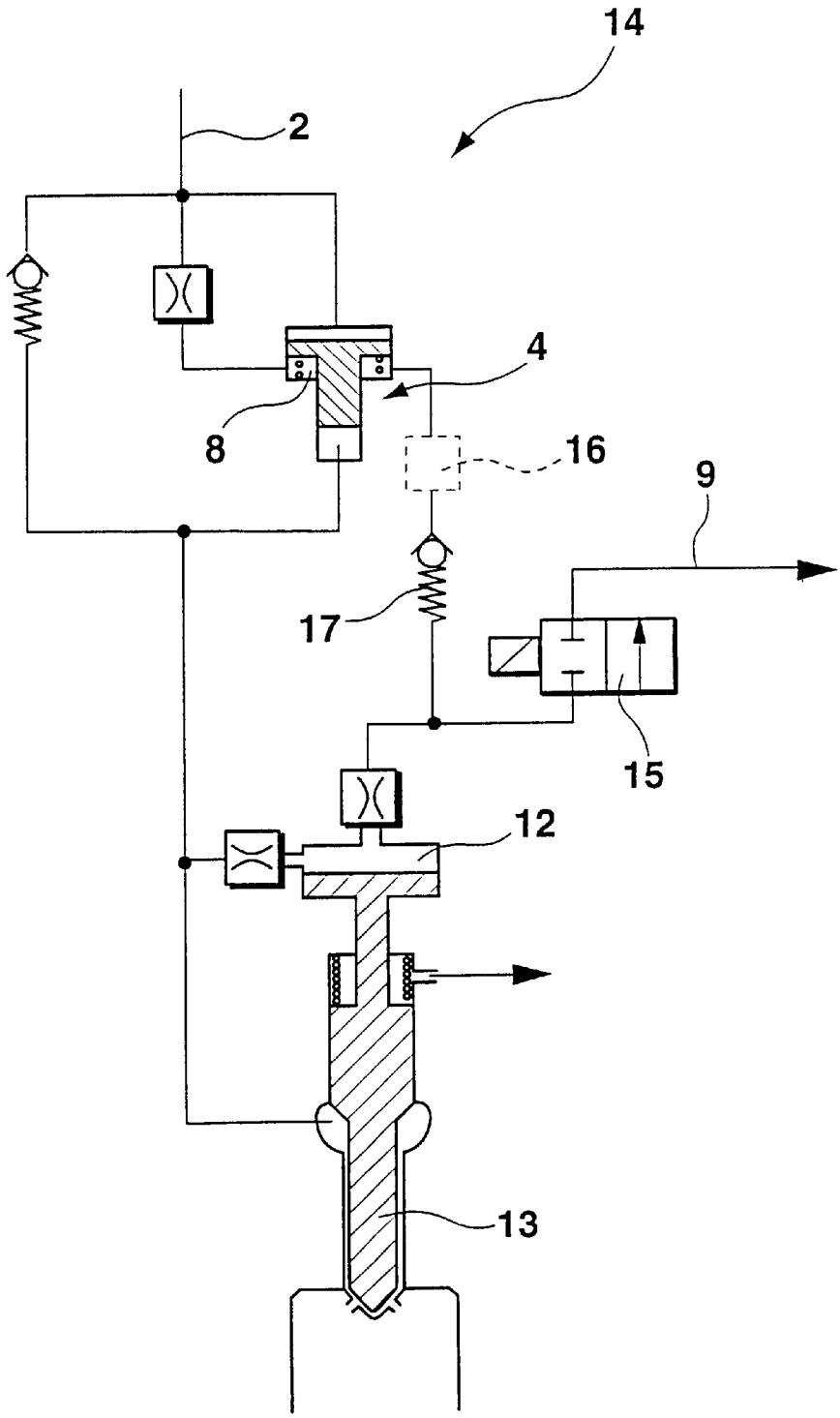
FIG. 2 shows a second stroke-controlled fuel injection device.

One or more additional delay members 16 can be provided, as is shown in FIG. 2, between the pressure booster 4 of a fuel injection device 14 and a 2/2 -way valve 15 for triggering the pressure booster 4 and the nozzle needle 13. The control chamber 12 can be decoupled from the differential chamber 8 via a check valve 17. If the 2/2 -way valve 15 is opened, the pressure in the control chamber 12 and in the differential chamber 8 drops simultaneously. The injection ensues by the opening of the nozzle needle 13, as described for FIG. 1. At the same time, by the pressure relief of the differential chamber 8, the pressure booster 4 is activated for the pressure buildup. If the valve 15 closes again, then the nozzle needle 13 is hydraulically closed. The pressure booster 4 is deactivated and returns to its outset position. A boot injection and a postinjection with the pressure booster 4 activated can be achieved by means of the at least one delay member 16.

Figure 3:
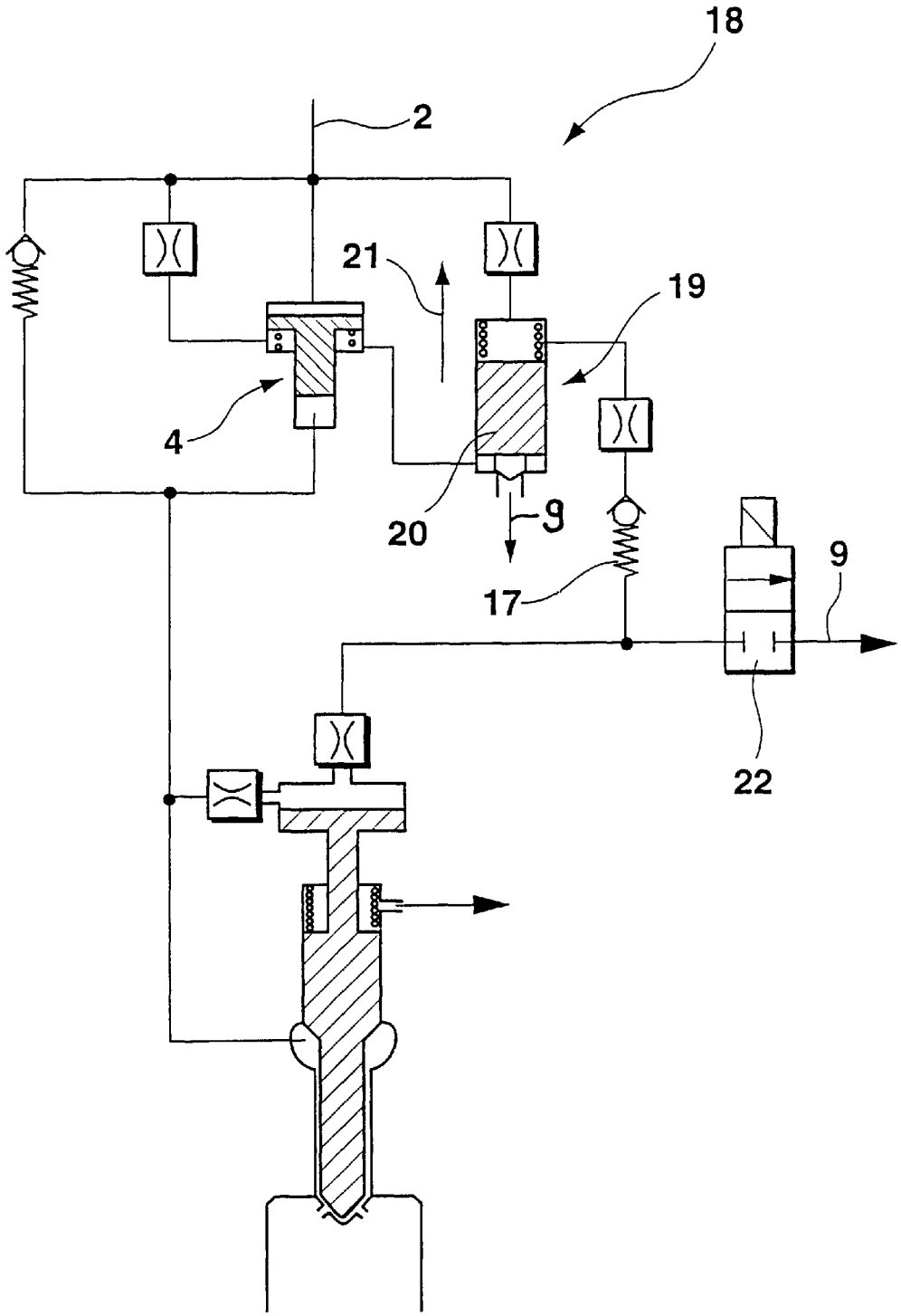
FIG. 3 shows a third stroke-controlled fuel injection device, with an additional delay member.

FIG. 3 shows an exemplary embodiment (fuel injection device 18) of the invention with a delay member 19. A valve piston 20 of the delay member 19 moves in the opening direction 21, after the activation of the valve 22. In the process, the piston 20 moves farther in the opening direction than is necessary to open the requisite outflow cross section. Upon deactivation of the pressure booster 4, the piston 20 must first traverse this additional stroke. If the piston 20 moves slowly, a corresponding delay is thus achieved.

The differential chamber 8 of the pressure booster 4 already described can thus be connected to a leakage line 9 with the aid of the 2/2 -way valve 22 and the valve piston 20. For performing a postinjection, the nozzle needle 13 is closed and opened again via the valve 22, without the pressure booster 4 having been turned off via the piston 20.

Figure 4:
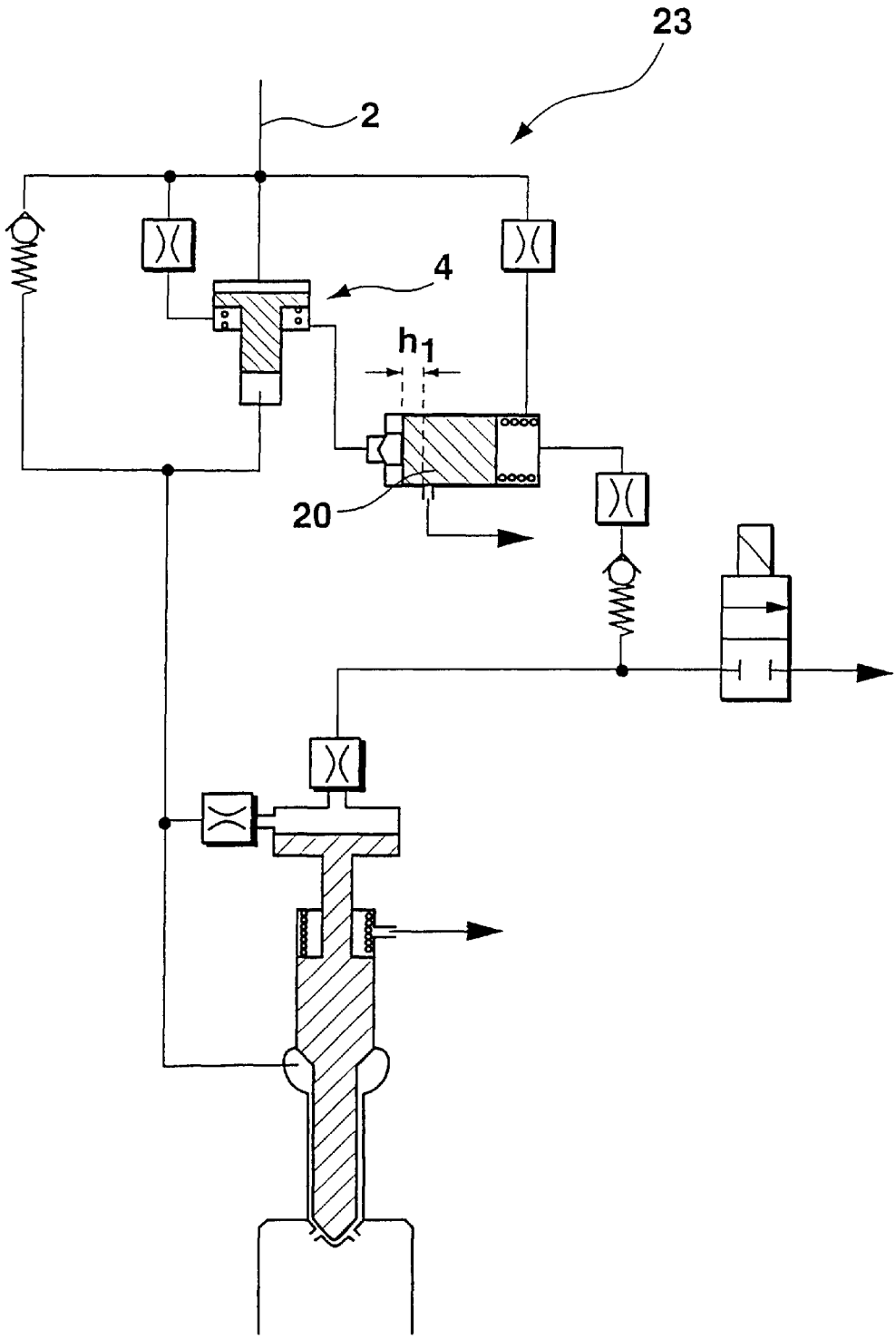
FIG. 4 shows a fourth stroke-controlled fuel injection device, with an additional delay member.

A delay in the activation of the pressure booster 4 is also possible, for the sake of attaining a boot injection. FIG. 4 shows one exemplary embodiment for this purpose. Both activation and deactivation, or turning on and off, of the pressure booster 4 can be delayed in a fuel injection device 23. The pressure booster 4 is not activated until the piston 20 has traversed the stroke $h_1$. This makes a boot injection a postinjection at high pressure possible.

The foregoing relates to preferred exemplary embodiments of the invention, it being understood that other variants and embodiments thereof are possible within the spirit and scope of the invention, the latter being defined by appended claims.

We claim:

1. A stroke-controlled fuel injection device (1; 14; 18; 23), comprising an injection nozzle (3) having a control chamber (12) for triggering a nozzle needle (13) and a nozzle chamber (11), a pressure booster (4) having a differential chamber (8), a leakage line (9) operably connected to said differential chamber and to said control chamber, communication of said control chamber (12) and of said differential chamber (8) with said leakage line (9) being controllable with the aid of a common valve (5; 15; 22).

2. The fuel injection device according to claim 1, further comprising a delay member disposed between the common valve (5; 15) and the differential chamber (8).

3. The fuel injection device according to claim 2, wherein the common valve is embodied by a 3/2-way valve (5).

4. The fuel injection device according to claim 2, wherein the common valve is embodied by a 2/2-way valve (15).

5. The fuel injection device according to claim 1, wherein the common valve is embodied by a 3/2-way valve (5).

6. The fuel injection device according to claim 1, wherein the common valve is embodied by a 2/2-way valve (15).

* * * * *